US005558240A

United States Patent [19]

Karp

[11] Patent Number: 5,558,240

[45] Date of Patent: Sep. 24, 1996

[54] CUP HANDLE

[76] Inventor: Morry Karp, 1295 Tower Grove Rd., Beverly Hills, Calif. 90210

[21] Appl. No.: 440,218

[22] Filed: May 12, 1995

[51] Int. Cl.[6] ..... B65D 23/10

[52] U.S. Cl. ..... 215/398; 220/769; 229/402

[58] Field of Search ..... 215/396, 398; 229/402; D7/533, 536, 543, 534; 220/769

[56] References Cited

U.S. PATENT DOCUMENTS

| | | | |
|---|---|---|---|
| 166,350 | 8/1875 | Dodge | D7/536 |
| D. 185,971 | 8/1959 | Saffer | D7/536 |
| D. 293,189 | 12/1987 | Sandler | D7/536 |
| D. 334,324 | 3/1993 | Pierce | D7/536 X |
| D. 363,001 | 10/1995 | Scholfield | D7/536 |
| 568,529 | 9/1896 | Frye | D7/536 X |
| 4,220,079 | 9/1980 | Sims | D7/536 X |
| 4,230,235 | 10/1980 | Di Amico | 229/402 |
| 5,203,471 | 4/1993 | Widman | 220/769 X |
| 5,295,598 | 3/1994 | Gerlach et al. | 215/398 X |

*Primary Examiner*—Allan N. Shoap
*Assistant Examiner*—Christopher J. McDonald
*Attorney, Agent, or Firm*—Marvin H. Kleinberg; Marshall A. Lerner; Michael J. Ram

[57] ABSTRACT

The invention comprises a novel cup handle that includes an outer and an inner section combined so that a user may grasp a cup or mug comfortably and firmly. The outer section is adapted to fit adjacent the user's palm, and the inner section is adapted to be grasped by the user's fingers.

16 Claims, 2 Drawing Sheets

CUP HANDLE

BACKGROUND OF THE INVENTION

1. Field of the Invention

The invention relates to beverage containers and, more particularly, a novel cup handle configured to fit comfortably in a user's grip which allows secure handling of mugs or cups.

2. Description of the Prior Art

A cup handle's principal if not sole function is to enable a user to lift the cup rather than grasping the cup directly with the hand. Handles are especially useful when the cup's contents are heated liquids, such as coffee, tea, or soup, and the cup itself becomes too hot to be held comfortably.

Cup handles are typically simple "C" shaped handles affixed to the side of the cup to provide for insertion of one or more fingers between the cup and its handle. Users hold the cup by hooking one or more fingers through the handle, and stabilize their grip by pressing their thumb and remaining fingers against the outside of the handle. In the alternative, the handle may be only large enough to allow insertion of the index finger. On cups made of fine china, handles may allow for no insertion of fingers through the handle at all, requiring the user to grip the handle as if it were a solid projection from the side of the cup.

There is a need for handles that provide a secure and comfortable grip for a large mug or cup. Some larger mugs have been designed as "travel mugs" with wide bases for increased stability and narrow mouths to limit heat loss. Travel mugs especially need to be held securely to prevent the beverage from spilling on the user.

The human hand is adapted to grasp round or rounded objects more securely and comfortably than "C" shaped objects because one side of the rounded surface can fit against the palm, and the other side can be gripped by the fingers and thumb. Some cup users have arthritis or other physical handicaps that limit their ability to firmly grip a conventional cup handle using their fingers and thumb in the usual manner.

The present invention provides a rounded handle that enables users to hold large cups comfortably and firmly, but which do not make the mug significantly heavier or more difficult to manipulate. This invention also provides a handle that is easier for users with arthritis or other physical handicaps to grip firmly without discomfort.

SUMMARY OF THE INVENTION

The improved cup handle of this type, according to the present invention, provides a cup handle that is comprised of two sections which together form a rounded or football shaped cup handle that is more easily held than conventional C-shaped handles.

Further features of the invention include the projections of thumb and finger stops on the outside of the outer cup handle section. Still further features of the invention include variations on the shapes and contours of the two sections of the improved cup handle.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

Further details are explained below with the help of the examples illustrated in the attached drawings in which.

DESCRIPTION OF THE PREFERRED EMBODIMENT

Figure 1:
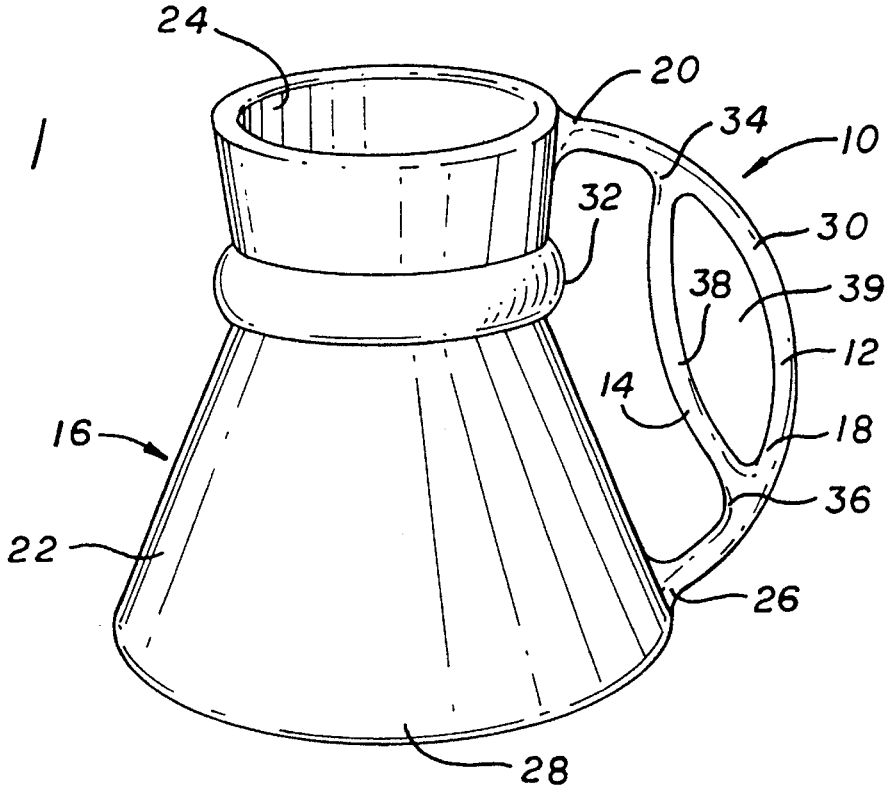
FIG. 1 is a side view of a cup with a cup handle according to a first embodiment of the present invention.

The invention comprises a novel cup handle 10 that includes an outer and an inner section 12, 14 combined so that a user may grasp a cup 16 or mug comfortably and firmly. The outer section 12 is adapted to fit adjacent the user's palm, and the inner section 14 is adapted to be grasped by the user's fingers.

The outer section 12 comprises a traditional cup handle 18. Like such handles, it comprises a first end 20 fastened to the cup body 22 and extended therefrom near the cup's mouth 24, and a second end 26 fastened to the cup body 22 more at a point closer to the cup's base 28 and extending therefrom. Between the first and second ends 20, 26 is a mid portion 30 spaced apart from the side 32 of the cup 16.

The inner section 14 includes a third end 34 fastened to the outer section's mid portion 30 but proximate to the outer section's first end 20, and a fourth end 36 attached to the outer section's mid portion 30, with a point of attachment near the outer section's second end 26. A mid portion 38 to the inner section 34, is located between the body 22 of the cup 16 and the outer section's mid portion 30. The distance between the points of attachment to the outer section's mid portion 30 of said third and fourth ends 34, 36, when such distance is measured in a straight line, is from about 1" to about 4".

The mid portion of the outer section 30 is spaced apart from the mid portion of the inner section 38 forming a circular or football shaped space 39 therebetween. The mid portion of the outer section 38, being C-shaped, fits into the palm of the user's hand comfortably. Similarly, the mid portion of the inner section 38, because it is spaced apart from the mid portion of the outer section 30, is adapted to be easily grasped by the user's fingers of that same hand.

Figure 2:
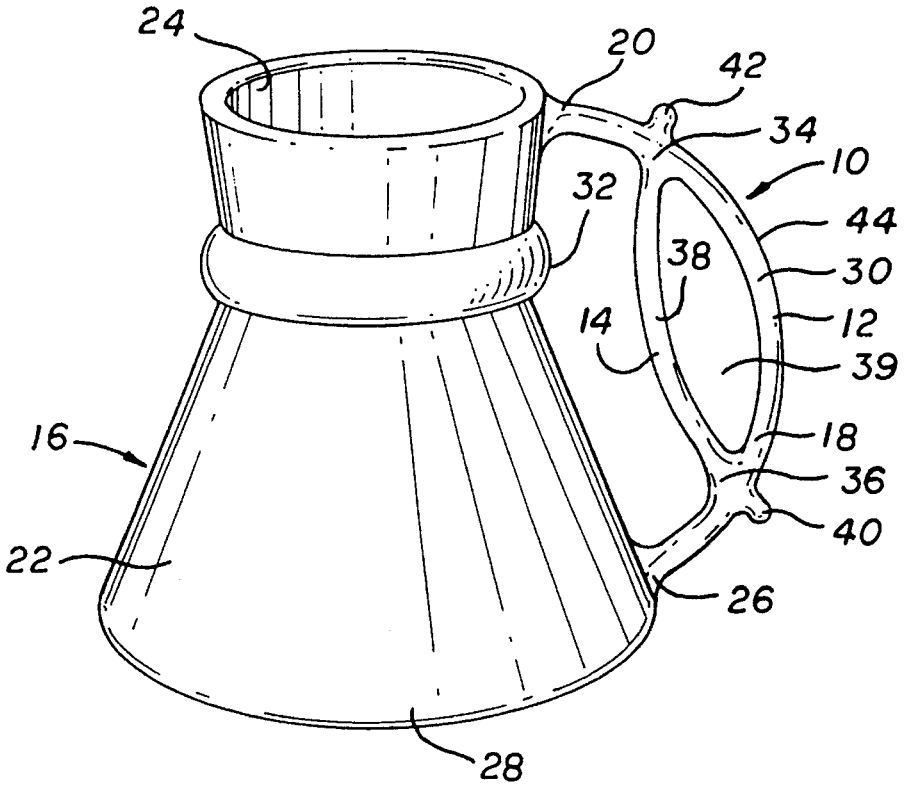
FIG. 2 is a side view of a cup with cup handle according to an alternative embodiment of the present invention illustrating the projections of thumb and finger stops on the outside of the outer cup handle section.

The invention provides for a finger "stop" 40 and a thumb "stop" 42 on the outer section 12 of the cup handle 10. The outer section 12 has an outer surface 44. Each finger or thumb "stop" 40, 42 comprises a ridge extending outwardly from the outer surface 44 of the outer section 12. In a preferred embodiment, and as illustrated in FIG. 2, the finger or thumb "stop" 40, 42 may be configured to create a visual illusion that each stop comprises an end of the inner section 14 that has extended through the mid portion 30 of the outer section 12.

Figure 3:
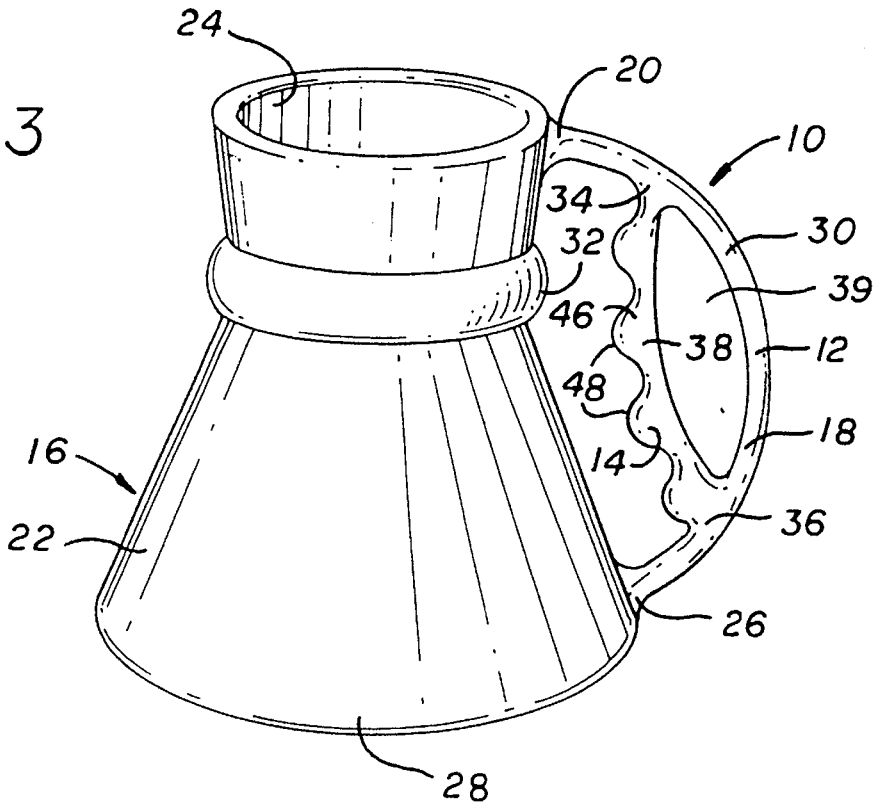
FIG. 3 is a side view of a cup with a cup handle according to a third embodiment of the invention.
Figure 4:
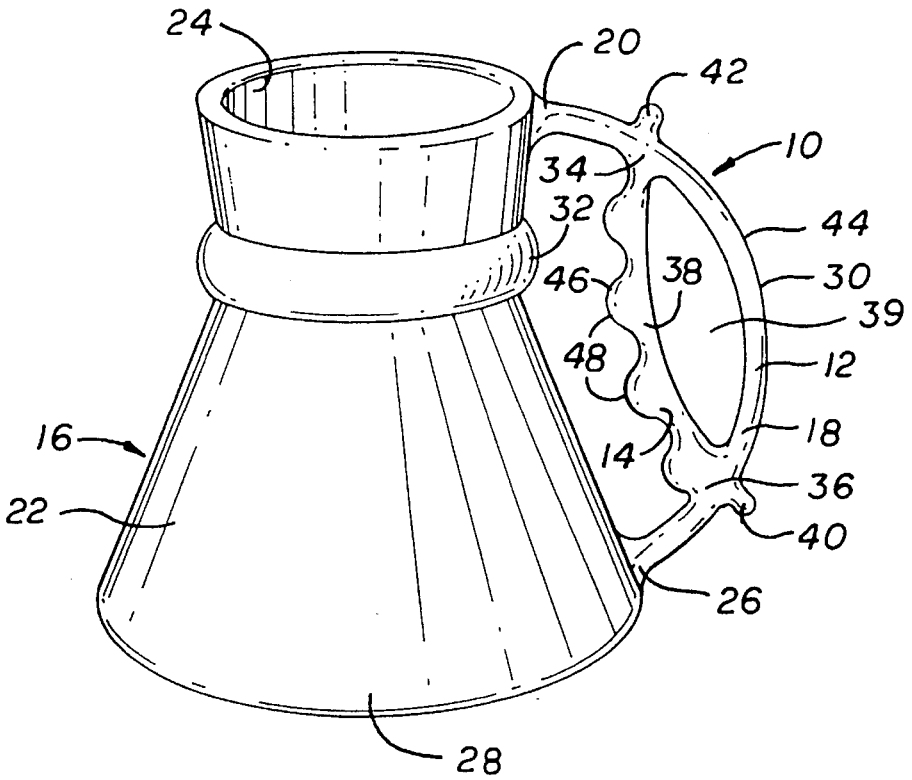
FIG. 4 is a side view of a cup with a cup handle according to a fourth embodiment of the present invention.

Further features of the invention, as illustrated in FIGS. 3 and 4, provide for stabilization of the user's grip. The inner section 14 has an inner surface 46 proximate the cup's body 22. This inner surface 46 may comprise one or more ridges 48 which extend away from the inner section 14 and towards the cup's body 22, which ridges are adapted to fit in between the user's fingers and provide additional stabilization for the fingers of the user's hand when the cup 16 is held. In a preferred embodiment, there are three or four ridges 48 on the inner surface 46 of the inner section 14.

Still further features of the invention include variations on the shapes and contours of the outer section 12 and inner section 14 of the improved cup handle 10.

What is claimed is:

1. In a cup having a mouth, a body and a base, a cup handle fastened to the cup comprising:

a. an elongated curved outer section having an exterior surface adapted to fit adjacent a user's palm and an elongated, oppositely curved inner section adapted to be grasped by a user's fingers;

b. said outer section including a first end fastened to the cup body and extending therefrom, said first end being fastened to the cup proximate the mouth of the cup;

a second end fastened to the cup body and extending therefrom spaced apart from said first end, said second end being fastened to the cup at a point between the mouth and the base of the cup, and an arcuate mid portion between said first and second ends, said mid portion being spaced apart from the side of the cup;

the distance between said points of attachment when measured in a straight line between said first and second ends being from about 1" to about 4"; and c. said inner section including a third-end, said third end fastened to said mid portion proximate to said first end;

a fourth end spaced apart from said third end, said fourth end being attached to said mid portion proximate to said second end;

and an arcuate inner portion, curved oppositely from said mid portion and spaced between the body of the cup and said outer section's mid portion;

the distance between said points of attachment of said third and fourth ends when measured in a straight line being less than the distance between said first and second ends.

2. A cup handle according to claim 1 further having a first and second stop at points in line with the location of the attachment of said third and fourth ends.

3. A cup handle according to claim 1 wherein said outer section has an outer surface, and said outer surface has at least one stop.

4. A cup handle according to claim 1 wherein said outer section has an outer surface, and said outer surface has two stops extended outwardly therefrom, which stops are configured to create a visual impression that each stop comprises an extension of said inner section that has penetrated through said mid portion of said outer section.

5. A cup handle according to claim 1 wherein said inner section has a surface proximate to said body of said cup, and said inner surface is adapted to stabilize the user's fingers when the user is grasping the cup handle.

6. A cup handle according to claim 1 wherein said inner section has an inner surface proximate to the body of the cup, said inner surface comprising at least one ridge adapted to fit between the user's fingers when the user is grasping the cup handle.

7. A cup handle according to claim 1 wherein said inner section has an inner surface proximate the cup's body, said inner surface comprising at least three ridges adapted to fit between the user's fingers when the user is grasping the cup handle.

8. A cup handle according to claim 1 further having a first and second stop at points in line with the location of the attachment of said third and fourth ends.

9. A cup handle according to claim 1 wherein said outer section has an outer surface, and said outer surface has at least one stop extending outwardly therefrom.

10. A cup handle according to claim 9 wherein said outer surface further includes a second stop extended outwardly therefrom, said stops being configured to create the visual impression that said stops are extensions of said inner section that have penetrated through said outer section mid portion.

11. A cup handle according to claim 1 wherein said inner section has a surface proximate to the body of the cup, and said inner surface being adapted to stabilize the user's fingers when the user grasps the cup handle.

12. A cup handle according to claim 10 wherein said inner section has an inner surface proximate to the body of the cup, said inner surface comprising at least one ridge adapted to fit between the user's fingers when the user grasps the cup handle.

13. A cup handle according to claim 12 wherein said inner surface includes at least three ridges adapted to fit between the user's fingers.

14. A cup handle according to claim 1 wherein said inner section has an inner surface proximate to the body of the cup, said inner surface comprising at least one ridge adapted to fit between the user's fingers when the user grasps the cup handle.

15. A cup handle according to claim 14 wherein said inner surface includes at least three ridges adapted to fit between the user's fingers.

16. A handle adapted to fasten to a cup having a mouth, a body and a base, the cup handle comprising:

an elongated, arcuately curved outer section having an exterior surface adapted to fit a user's palm and an elongated, oppositely curved inner section adapted to be grasped by a user's fingers;

a. said outer section including i. a first end of the cup;

ii. a second end spaced apart from said first end, and iii. an arcuate mid portion between said first and second ends;

the distance between said points of attachment when measured in a straight line between said first and second ends being from about 1" to about 4"; and b. said inner section including;

i. a third end, said third end fastened to said mid portion proximate to said first end;

ii. a fourth end spaced apart from said third end, said fourth end being attached to said mid portion proximate to said second end;

said inner portion being curved oppositely from said mid portion and spaced between the body of the cup and said outer section's mid portion;

the distance between the points of attachment of said third and fourth ends, when measured in a straight line, being less than the distance between said first and second ends, wherein the handle has the appearance of intersecting, oppositely curved arcs.

* * * * *